United States Patent [19]

Smits

[11] Patent Number: 5,012,152

[45] Date of Patent: Apr. 30, 1991

[54] IMAGE INTENSIFIER TUBE COMPRISING COATED ELECTRODES

[75] Inventor: Petrus G. H. J. Smits, Heerlen, Netherlands

[73] Assignee: U.S. Philips Corp., New York, N.Y.

[21] Appl. No.: 461,887

[22] Filed: Jan. 8, 1990

[30] Foreign Application Priority Data

Jan. 9, 1989 [NL] Netherlands ..... 8900038

[51] Int. Cl.[5] ..... H01J 19/28

[52] U.S. Cl. ..... 313/107; 313/524; 313/353; 313/355; 313/106

[58] Field of Search ..... 313/107, 365, 380, 383, 313/388, 390, 524, 527, 106, 525, 549, 357, 355; 250/213 VT

[56] References Cited

U.S. PATENT DOCUMENTS 2,879,406 3/1959 Wachtel ..... 313/106

3,895,250 7/1975 Christgau et al. ..... 313/355 X

*Primary Examiner*—Donald J. Yusko

*Assistant Examiner*—Michael Horabik

*Attorney, Agent, or Firm*—William J. Botjer

[57] ABSTRACT

Metal parts of an image intensifier tube which are exposed to a high voltage are coated with a layer of aluminum phosphate glass in order to preclude local discharge phenomena; the aluminum phosphate glass can be deposited in a thin, uniform layer already at a comparatively low flow temperature. Because the layer is thin, it is not necessary to take into account differences in coefficients of expansion, so that a high degree of freedom is achieved as regards the choice of materials for the metal parts.

5 Claims, 1 Drawing Sheet

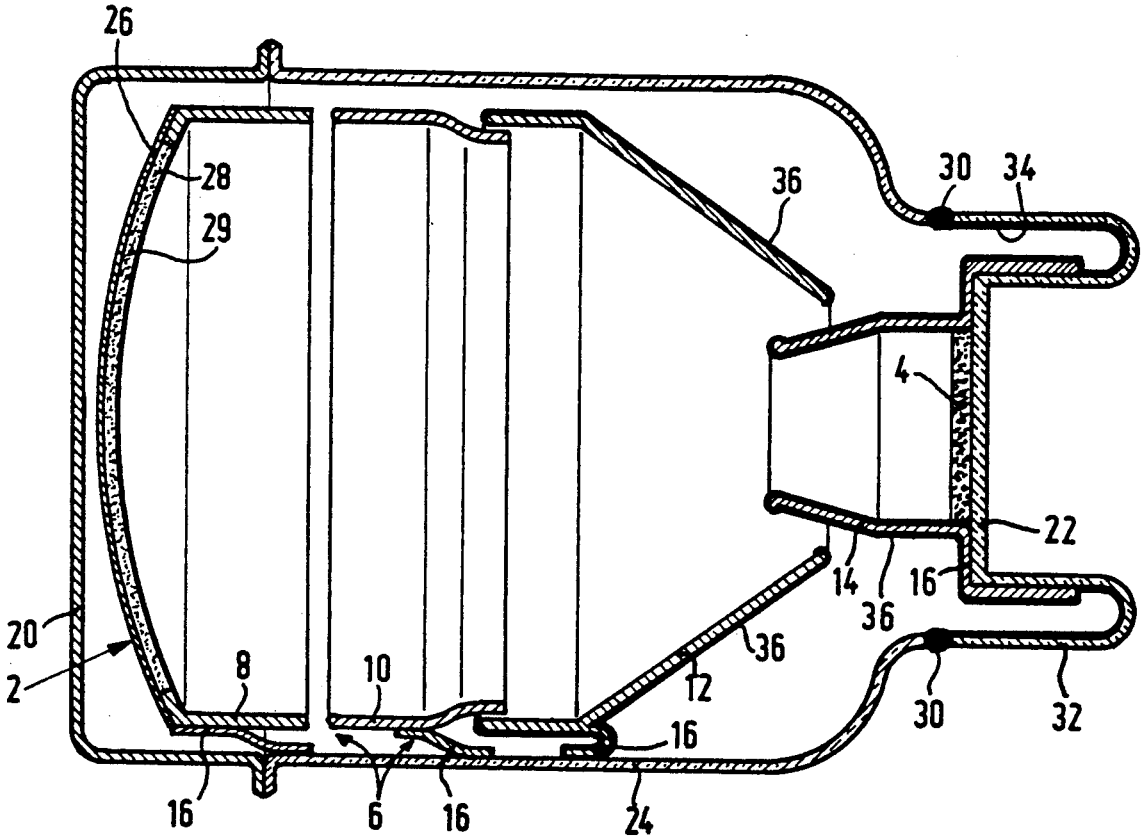
26
28
29
36
30
34
4
22
14
16
36
36
20
2
8
10
12
16
30
32
16
6
16
24

IMAGE INTENSIFIER TUBE COMPRISING COATED ELECTRODES

BACKGROUND OF THE INVENTION

The invention relates to an image intensifier tube, comprising an electron-optical system for imaging photoelectrons emanating from an entrance screen onto an exit screen, which electron-optical system includes metal parts provided with a coating layer.

An image intensifier tube of this kind is known from U.S Pat. No. 2,879,406. In an image intensifier tube described therein, metal parts of the electron-optical system are coated with a glass or a vitruous enamel coating. The coating material has a coefficient of expansion adapted to that of the material of the parts to be coated. Consequently, the choice of the metal is seriously restricted and for electrode parts or mounting parts it is in principle limited to an alloy of iron, chromium and nickel.

SUMMARY OF THE INVENTION

It is an object of the invention to eliminate this restriction; to achieve this, an image intensifier tube of the kind set forth in accordance with the invention is characterized in that the coating layer contains aluminium phosphate glass which is deposited in a comparatively thin layer in surfaces of the metal parts to be coated.

Because aluminium phosphate glass can be deposited in a thin layer and exhibits a high viscocity even at a comparatively low temperatures, much more freedom exists as regards the coefficients of expansion of the metal to be coated and the glass. Moreover, because of the comparatively high viscocity and the small thickness of the layer, the layer can readily follow irregularities of the surface for suitable coating. It is an additional advantage that any loose particles in the tube do not adhere to the glass layer so that they cannot act as sputtering elements.

The coating layer in a preferred embodiment has a thickness of at the most approximately 2.5 μm and is deposited onto the metal parts by brushing, immersion or spraying. It has been found that even at a temperature of approximately 200° C. the aluminium phosphate glass already flows so that if forms a suitably adhesive, uniform layer and that it can be successfully used on, for example parts made of stainless steel. Examples of image intensifier tubes in which coating layers of aluminum phosphate glass can be used are, for example X-ray image intensifier tubes, brightness intensifier tubes, infra-red intensifier tubes etc.

Some preferred embodiments in accordance with the invention will be described in detail hereinafter with reference to the drawing.

BRIEF DESCRIPTION OF THE DRAWING

The sole FIGURE shows an x-ray image intensifier tube of the preferred embodiment.

DETAILED DESCRIPTION OF THE PREFERRED EMBODIMENT

The sole FIGURE of the drawing shows an X-ray image intensifier tube which comprises an entrance screen 2, an exit screen 4, and an electron-optical system 6 with a shielding electrode 8, a focusing electrode 10, a first anode 12, an output anode 14 and fixing means 16. All said components are accommodated in a housing which comprises an entrance window 20, an exit window 22 and an envelope portion 24. In the present embodiment the entrance screen 2 comprises a metal support 26, a comparatively thick luminescent layer 28, preferably made of CsI, and a photocathode 29 deposited on the luminescent layer, possibly via an intermediate layer. The envelope portion, including the entrance screen, is made of metal with in this case, via a bead 30, a transition to a glass portion 32 which may be provided with a resistive layer 34 on its inner side. Using the electron-optical system, photoelectrons emanating from the photocathode are imaged onto the exit screen where they form a light-optical image which can be detected via the exit window. The photocathode is customarily connected to ground potential and the output anode with the exit screen is connected, for example to 30 kV. Notably on electrodes or fixing means carrying a comparatively high potential, discharge phenomena can readily occur; during such phenomena, for example light can also be emitted, which light is capable of reaching the photocathode, possibly via reflections, where it could release undesirable photoelectrons disturbing the imaging. In accordance with the invention notably the electrodes and/or fixing means are coated with a layer 36 of aluminium phosphate glass so that inhomogeneities in the field strength are avoided at these areas and the adherence of loose particles is precluded. Analogously, aluminium phosphate glass coatings can be used in other tubes comprising a photocathode where comparatively high potentials occur, for example in the image intensifier tube disclosed in U.S. Pat. No. 4,286,148.

I claim:

1. An image intensifier tube, comprising an electron-optical system for imaging photoelectrons emanating from an entrance screen onto an exit screen, which electron-optical system includes metal parts provided with a coating layer, characterized in that the coating layer contains aluminium phosphate glass which is deposited in a comparatively thin layer on surfaces of metal parts to be coated.

2. An image intensifier tube as claimed in claim 1, characterized in that the coating layer has a thickness of at the most approximately 2.5 μm.

3. An image intensifier tube as claimed in claim 1, characterized in that the metal parts to be coated are made of stainless steel.

4. An image intensifier tube as claimed in claim 1, characterized in that the entrance screen comprises a layer of luminescent material, deposited on a support, and an adjoining photocathode.

5. An image intensifier tube as claimed in claim 1, characterized in that the tube comprises a photocathode which is arranged on an entrance window and which is sensitive to radiation to be detected.

* * * * *